US006758144B2

(12) United States Patent
Raidt

(10) Patent No.: US 6,758,144 B2
(45) Date of Patent: Jul. 6, 2004

(54) FUN VEHICLE AND BOB, TOBOGGAN OR ROLLER COASTER RUN FOR USING THE SAME

(76) Inventor: Peter Raidt, Schuhstrasse 45, 72108 Rottenburg (DE)

( * ) Notice: Subject to any disclaimer, the term of this patent is extended or adjusted under 35 U.S.C. 154(b) by 0 days.

(21) Appl. No.: 10/149,289

(22) PCT Filed: Oct. 24, 2001

(86) PCT No.: PCT/EP01/12307

§ 371 (c)(1),
(2), (4) Date: Oct. 21, 2002

(87) PCT Pub. No.: WO02/34347

PCT Pub. Date: May 2, 2002

(65) Prior Publication Data

US 2003/0089265 A1 May 15, 2003

(30) Foreign Application Priority Data

Oct. 24, 2000 (DE) ..... 200 18 121 U

(51) Int. Cl.[7] ..... A63G 1/00
(52) U.S. Cl. ..... 104/53; 104/63
(58) Field of Search ..... 104/53, 63, 64, 104/56, 60, 67, 83, 85, 59, 138.1; 105/199.1, 199.2

(56) References Cited

U.S. PATENT DOCUMENTS

| | | | | |
|---|---|---|---|---|
| 3,114,332 A | * | 12/1963 | Bacon et al. | 104/63 |
| 6,487,975 B1 | * | 12/2002 | Gordon | 104/53 |

FOREIGN PATENT DOCUMENTS

| | | | | |
|---|---|---|---|---|
| CH | 658 431 A | | 11/1986 | |
| CH | 658431 A5 | * | 11/1986 | B61F/5/22 |
| DE | 23 30 933 A1 | | 1/1975 | |
| DE | 87 17 429 U | | 12/1988 | |
| EP | 600300 A2 | * | 6/1994 | A63G/7/00 |
| GB | 2109252 A | * | 6/1983 | A63G/7/00 |
| JP | 04191170 A | * | 7/1992 | B61F/5/22 |

* cited by examiner

*Primary Examiner*—Frantz F. Jules
(74) *Attorney, Agent, or Firm*—Birch, Stewart, Kolasch & Birch, LLP

(57) ABSTRACT

An amusement vehicle for a bob or toboggan run. A basic vehicle frame has arranged thereon rollers and/or slide members for movement of the vehicle, as well as a second frame for accommodation of one or several persons. The second frame is movable essentially perpendicular to the driving direction of the basic vehicle frame. The invention also includes a bob, toboggan or roller coaster run for such an amusement vehicle.

9 Claims, 4 Drawing Sheets

FUN VEHICLE AND BOB, TOBOGGAN OR ROLLER COASTER RUN FOR USING THE SAME

This application is the national phase under 35 U.S.C. § 371 of PCT International Application No. PCT/EP01/12307 which has an International filing date of Oct. 24, 2001, which designated the United States of America.

BACKGROUND OF THE INVENTION

1. Field of the Invention

The present invention pertains to a fun vehicle as well as to a bob, toboggan or roller coaster run for using the vehicle.

2. Discussion of Background

Already a great variety of amusement rides entertain visitors at fairs and amusement parks. Among others, also roller coaster runs and summer toboggan runs have to be mentioned.

For example, DE 2330933 a toboggan run device is shown in which a toboggan sledge can slide on a toboggan run device constructed of several segments, using gravity. In this kind of toboggan run device the sledge is not bound to an accurately defined path, in the form of rails e.g., but within certain limits is freely movable on said toboggan run device.

Another kind of toboggan run device is described in DE 29800205 in which a vehicle is movable on a rail arrangement also using gravity. This kind of toboggan run device essentially really corresponds to the principle of a roller coaster run only with the difference that in a roller coaster run several sledges are connected to one another and the vehicles cannot be braked individually.

However, it is a disadvantage in these toboggan devices that to compensate for the centrifugal forces, the path must be inclined with respect to the curve axis in the curves, so that the drive does not have to compensate for the centrifugal force by structural strength alone. It is a problem that the lateral inclination of the path due to the different drives never does exactly correspond to the centrifugal forces.

SUMMARY OF THE INVENTION

Therefore, it is the object of the present invention to create an amusement vehicle for a bob or toboggan run device in particular, offering high driving pleasure, with expense as low as possible and simple construction as well as eliminating the drawbacks of the prior art.

The invention is based on the basic idea of compensating for centrifugal forces acting on the driver of an amusement vehicle during passage of curves, by a seat arrangement which is freely movable in the perpendicular direction to the driving direction of the amusement vehicle. In this way the actual centrifugal forces are directly converted into the movement of the seat arrangement. For this purpose, the amusement vehicle in accordance with the present invention, in addition to a basic vehicle frame on which rollers and/or slide members for movement of the vehicle are arranged, includes a second frame on which one or several seats can be arranged and which is movably arranged on the basic vehicle frame essentially perpendicular to the moving direction of the vehicle. For this, it is advantageous to arrange a chassis on the basic vehicle frame, on which the second frame is movable.

In order to absorb the centrifugal forces correspondingly, it is advantageous that the second frame moves in its moving direction along a closed orbit or a segment of a circle. This, thus, means that the chassis is built as an open or closed pipe segment. In this way it is achieved that in curve drives, the centrifugal forces displace the second frame with the driver or drivers along the cylinder surface of the pipe segment in one direction or the other laterally or upwardly, the centrifugal forces being reduced thereby.

It is particularly advantageous to arrange the second frame as well as the amusement vehicle itself on a rail arrangement. By means of the rails, on one hand, an accurately predefined movement of the amusement vehicle as well as the second frame is possible with respect to the basic vehicle frame and, on the other hand, the rail arrangements offer a simple solution for providing for safe fixation to avoid the vehicle or the second frame from being lifted from the rails. Such a securing device which preferably is provided on the vehicle as well as on the second frame movable in the vehicle, can in advantageous manner consist of opposing pairs of rollers and/or slide members so that the opposing pairs of rollers and/or slide members encircle the rails in such a manner that detaching from the rails is impossible.

Due to the design of the amusement vehicle with a seat arrangement freely movable in a direction perpendicular to the moving direction, an increased driving fun for the user is achieved as well as a simplification for the construction of the path, preferably consisting of a rail arrangement arranged on a scaffold. The path namely no longer has to include inclinations to compensate for centrifugal forces. Consequently, it is advantageous to design the path such that in curves the path no longer is inclined with respect to the curve axis, i.e. thus essentially is arranged in perpendicular to the curve axis. Apart from that, the path, similar to known roller coaster runs, can include sloping, ascending or plane partial path sections.

By the bob, toboggan or roller coaster run device in accordance with the present invention and/or the amusement vehicle, respectively, provided therefore, a broad width of design of a bob or toboggan run is given in which multiple effects can be effected which severely increase driving pleasure for the user. For example, it is conceivable to arrange short and narrow curve radii in such a manner that the movable seat arrangement in the amusement vehicle due to the impulse caused by the centrifugal forces is pushed into a looping movement within a closed pipe-like chassis in which the movable seat arrangement is provided for.

BRIEF DESCRIPTION OF THE DRAWINGS

Further advantages, characteristics and features of the present invention become evident with reference to the following detailed description of an embodiment with reference to the attached drawings which show.

DESCRIPTION OF THE PREFERRED EMBODIMENTS

Figure 1:
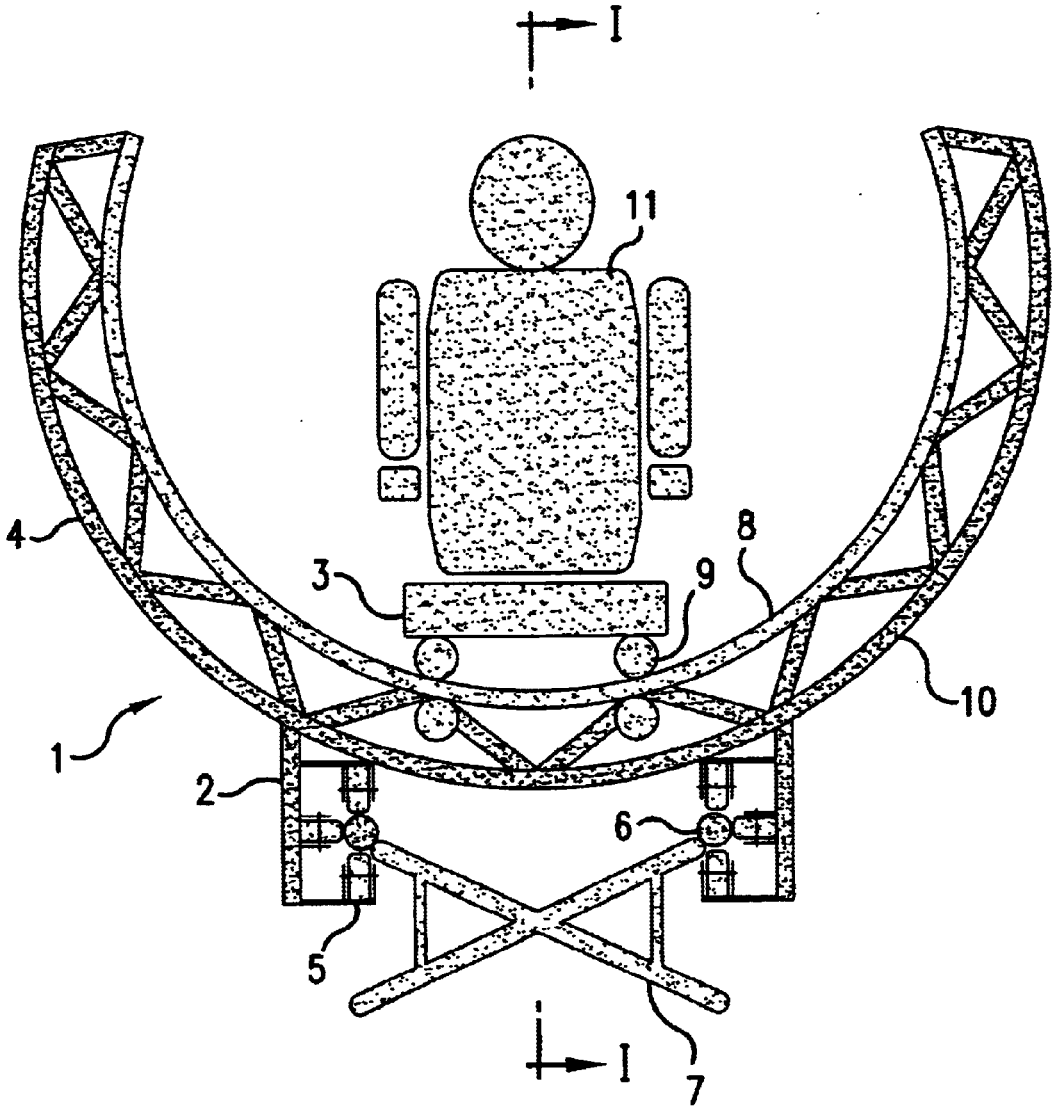
FIG. 1 a cross-sectional view through an amusement vehicle along the line II—II of FIG. 3 in accordance with the present invention as well as the rail arrangement on which the amusement vehicle is movable.

FIG. 1 in a cross-sectional view shows an amusement vehicle 1 located on a rail arrangement 6, 7 on which it is movable. The rail arrangement consists of the rails 6 and the support scaffold 7.

The amusement vehicle 1 includes a basic vehicle frame 2 on which rollers 5 are provided serving for movement of the amusement vehicle 1. In total the amusement vehicle 1 includes 3 pairs of opposing rollers 5 so that the amusement vehicle 1 is safely arranged on the rails 6.

Figure 3:
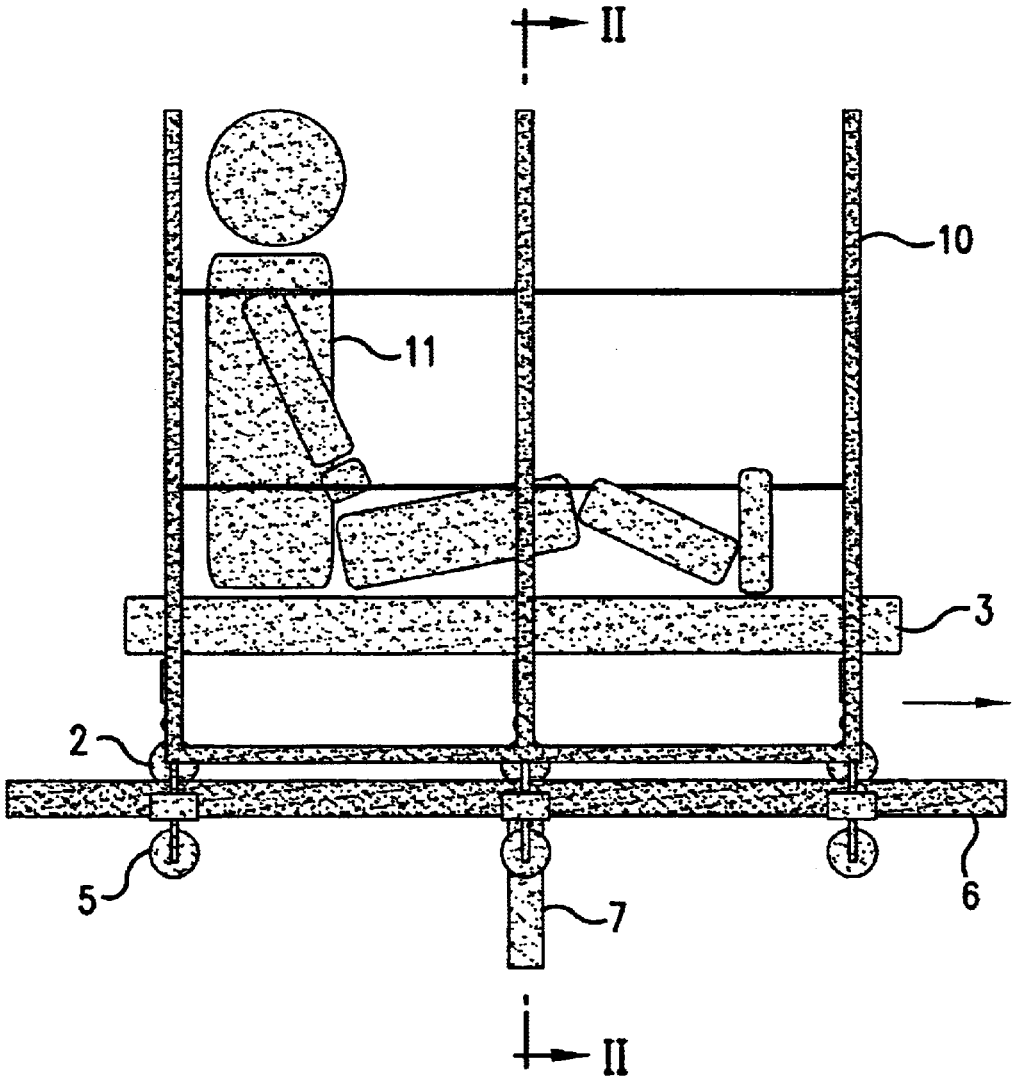
FIG. 3 a longitudinal section along line I—I of FIG. 1 through an amusement vehicle in correspondence with FIGS. 1 and 2.
Figure 4:
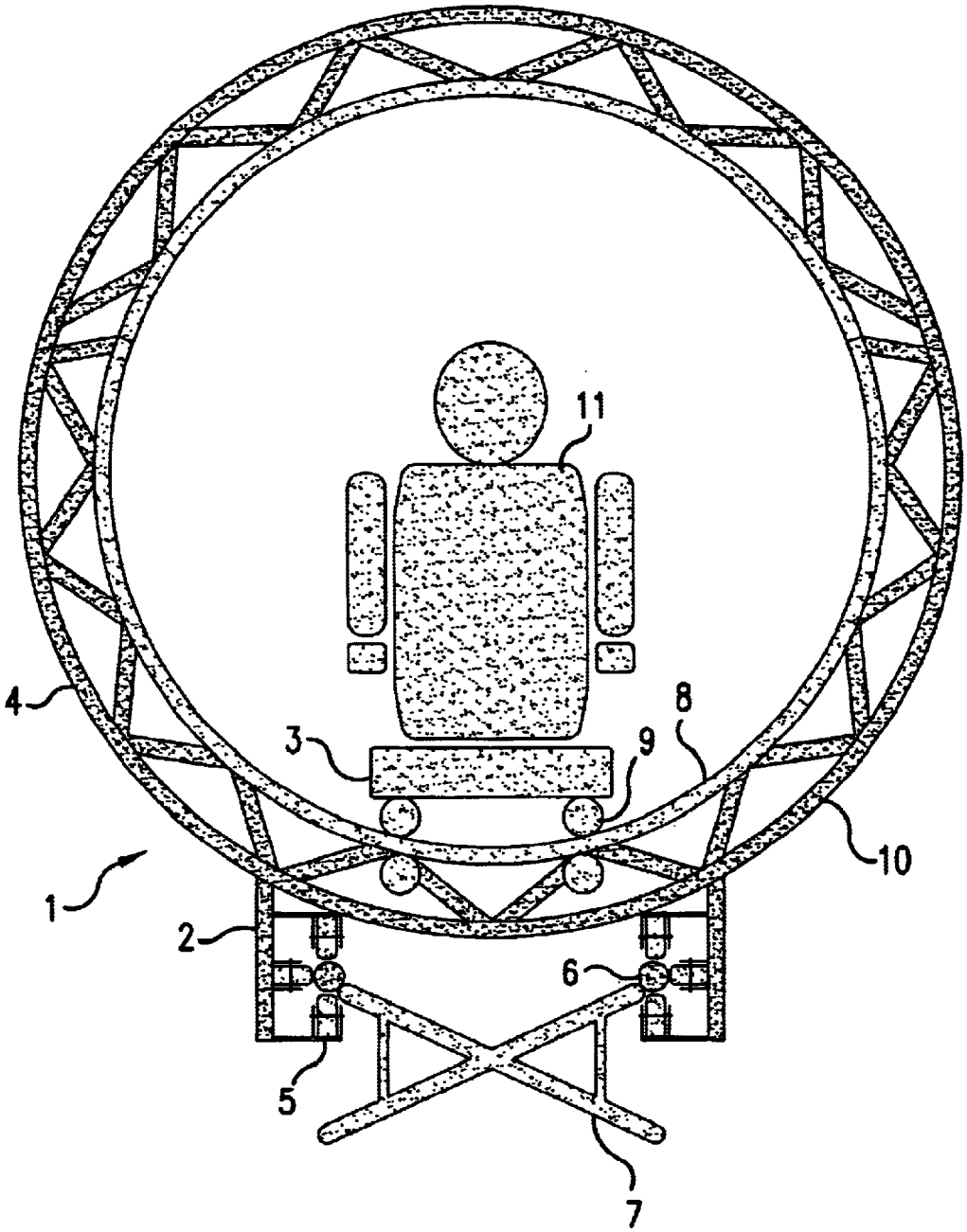
FIG. 4 is a cross-sectional view of a second embodiment of the present invention.

On the vehicle frame 2 furthermore a chassis 10 is provided, which in the present embodiment is constructed as a semicircular pipe section, the outer surface 4 in the embodiment (FIG. 3) being constructed open. However, it also is conceivable to embody said vehicle closed, i.e. to embody said chassis 10 as a full-surface pipe member as shown in FIG. 4. On the inside of the chassis 10, in addition, guide rails 8 are provided on which a second frame 3 is movable by means of second rollers 9. By the guide rails 8, the moving direction for the second frame 3 perpendicular to the driving direction of the amusement vehicle 1 or the basic vehicle frame 2 is given. A movement parallel to the driving direction of the amusement vehicle 1 or the basic vehicle frame 2 is not possible for the second frame 2. On the second frame 3, a seat 11 is indicated schematically, on which a person can take a seat.

Figure 2:
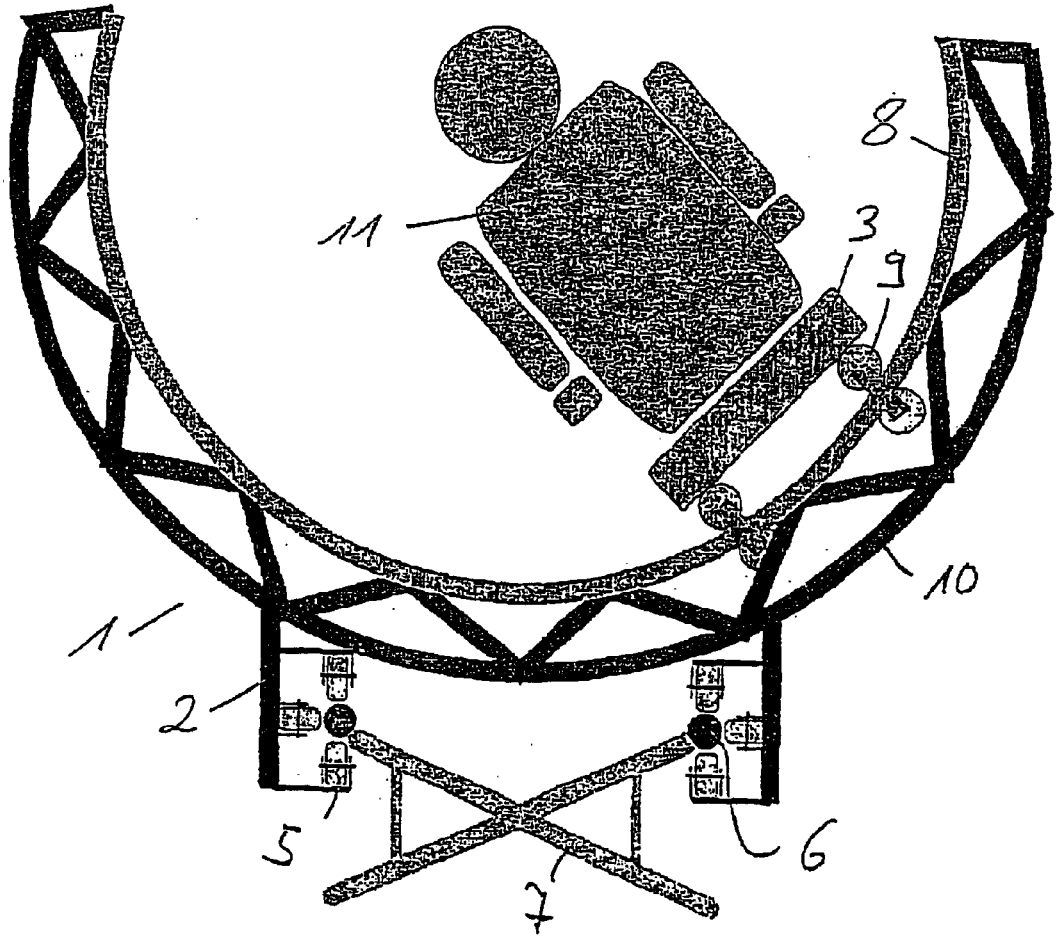
FIG. 2 a representation of the amusement vehicle in accordance with FIG. 1 in a curve passage.

The operating mode of the amusement vehicle 1 now is such that, as can be seen from FIG. 2, the path consisting of the scaffold 7 and the rails 6 in the curves is not inclined with respect to the curve axis, so that during curve passage, the centrifugal forces acting on the second frame 3 move the second frame 3 together with the seat 11 along the guide rails 9 and/or along the segment of a circle, respectively, of the pipe chassis 10. The driver, thus in correspondence with the centrifugal forces occurring in the curves, is moved either in one direction or the other within the pipe chassis 10, the driver therein due to the circular or circle-segmental cross-section of the pipe chassis 10 also being moved upwardly by the centrifugal forces.

In the shown embodiment the amusement vehicle does not include its own drive, but is moved by gravity only. Correspondingly, the path similar to a roller coaster run or a toboggan run is provided with corresponding inclinations with respect to the driving direction.

What is claimed is:

1. An amusement vehicle for a bob or toboggan run comprising, a basic vehicle frame (2) on which rollers (5) and/or slide members for movement of said vehicle (1) are arranged, and a second frame (3) for accommodation of one or several persons (11), which moves essentially perpendicular to the driving direction of said basic vehicle frame (2), and along an orbit vertically closed in cross-section in driving direction of said basic vehicle frame (2) so that during passage of said vehicle on curves said second frame (3) is displaced along said orbit by centrifugal forces.

2. The amusement vehicle as defined in claim 1, wherein said vehicle (1) and/or said second frame (3) are movable on rails (6,8).

3. The amusement vehicle as defined in claim 2, wherein said vehicle (1) and/or said second frame (3) include safety means preventing detachment of said vehicle (1) and/or said second frame (3) from said rails (6,8).

4. The amusement vehicle as defined in claim 3, wherein said safety means consist of rollers (5,9) and/or slide members arranged opposite to one another.

5. The amusement vehicle as defined in claim 1, wherein said second frame (2) includes one or several seats.

6. A bob, toboggan or roller coasting run with at least one amusement vehicle (1) having a basic vehicle frame (2) on which rollers (5) and/or slide members for movement of said vehicle (1) are arranged, and a second frame (3) for accommodation of one or several persons (11), which moves essentially perpendicular to the driving direction of said basic vehicle frame (2), and along an orbit vertically closed in cross-section in driving direction of said basic vehicle frame (2) so that during passage of said vehicle on curves said second frame (3) is displaced along said orbit by centrifugal forces and a path (6,7) on which said amusement vehicle (1) can move.

7. The bob, toboggan or roller coasting run as defined in claim 6, wherein said path includes a rail or track arrangement (6).

8. The bob, toboggan or roller coasting run as defined in claim 6, wherein said path in driving direction is plane, sloping or ascending, said path in curves being arranged essentially in perpendicular to the curve axis.

9. A bob, toboggan or roller coasting run with at least one amusement vehicle (1) having a basic vehicle frame (2) on which rollers (5) and/or slide members for movement of said vehicle (1) are arranged, and a second frame (3) including at least one seat for accommodation of one or several persons (11), which moves essentially perpendicular to the driving direction of said vehicle frame (2), and along an orbit vertically closed in cross-section in driving direction of said basic vehicle frame (2) so that during passage of said vehicle on curves said second frame (3) is displaced along said orbit by centrifugal forces and a path (6,7), including a rail or track arrangement on which is in said amusement vehicle (1) can move, said path having a driving direction which is in a plane, sloping or ascending, said path and curves being arranged essentially perpendicular to the curve axis, said vehicle and/or second frame including a safety means including rollers and/or slide members arranged opposite to one another, for preventing detachment of said vehicle and/or said frame from said rails.

* * * * *